United States Patent [19]

Singer

[11] 3,970,249

[45] July 20, 1976

[54] SPRAYING ATOMIZED PARTICLES

[75] Inventor: Alfred Richard Eric Singer, Swansea, Wales

[73] Assignee: National Research Development Corporation, London, England

[22] Filed: Nov. 6, 1974

[21] Appl. No.: 521,403

[30] Foreign Application Priority Data

Nov. 6, 1973 United Kingdom ..... 51437/73

[52] U.S. Cl. ..... 239/102; 118/63; 239/422

[51] Int. Cl.² ..... B05B 3/14

[58] Field of Search ..... 239/422, 102, 407, 297, 239/543, 291, 292, 299; 222/193; 118/63; 266/35; 164/66

[56] References Cited

UNITED STATES PATENTS

| | | | |
|---|---|---|---|
| 2,812,612 | 11/1957 | Vang | 239/102 |
| 3,111,931 | 11/1963 | Bodine | 239/102 |
| 3,243,122 | 3/1966 | Snaper | 239/102 |
| 3,478,969 | 11/1969 | Lund | 118/63 |
| 3,554,521 | 1/1971 | Rhydderch | 266/35 |
| 3,746,257 | 7/1973 | Broad et al. | 239/102 |

*Primary Examiner*—Robert R. Song
*Assistant Examiner*—Gene A. Church
*Attorney, Agent, or Firm*—Cushman, Darby & Cushman

[57] ABSTRACT

Apparatus for the spraying of atomized particles, which comprises means for producing a stream of gas atomized particles, means for directing a secondary stream of gas against the stream of gas atomized particles and control means adapted for repeated cyclic operation for varying the secondary stream of gas in such a manner as, in operation, to deflect the stream of gas atomized particles and impart thereto an oscillation substantially in a single plane. There is also included a process for spraying atomized particles which comprises producing a stream of gas atomized particles and directing a secondary stream of gas against the stream of gas atomized particles in such a manner as to deflect the stream of gas atomized particles and impart thereto an oscillation substantially in a single plane.

14 Claims, 1 Drawing Figure

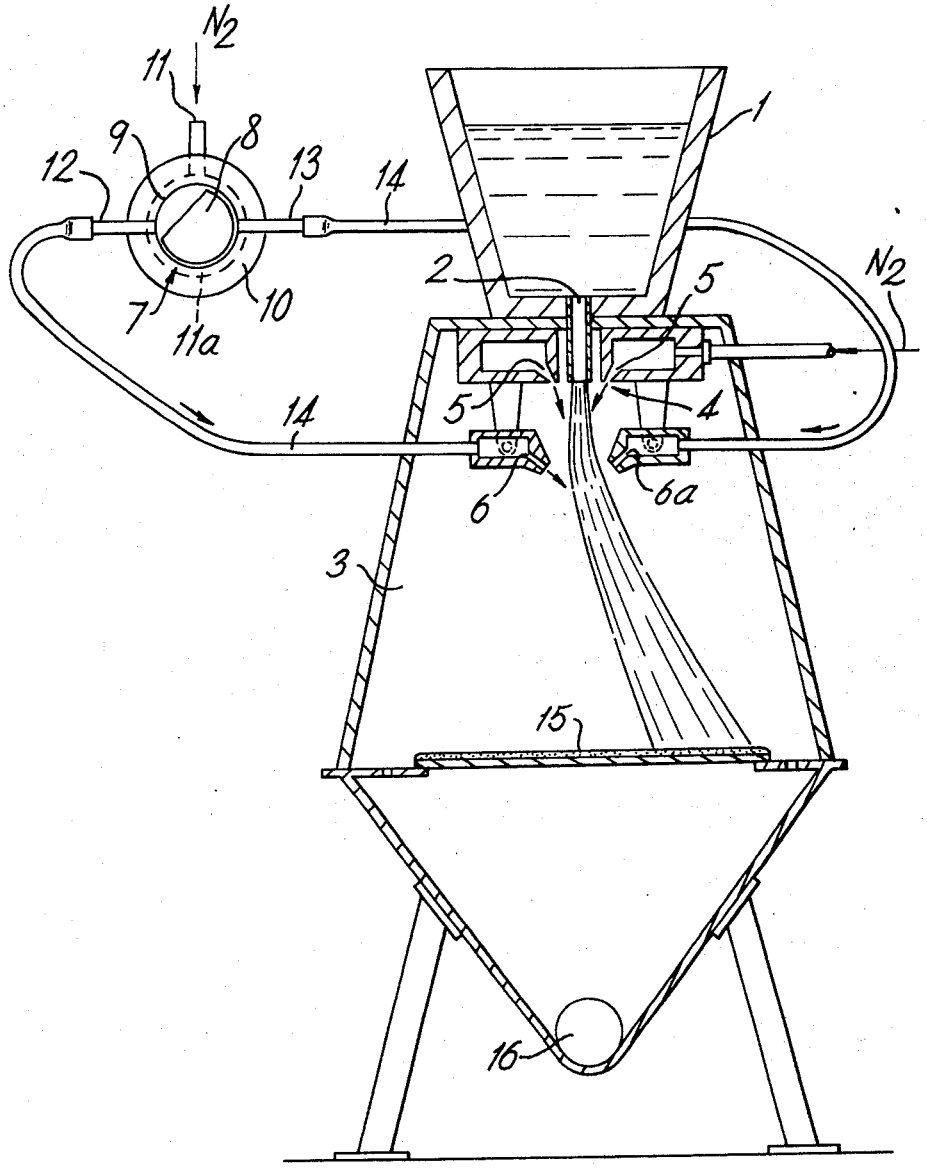
N2
11
9
8
12
13
14
1
2
5
N2
7
11a
10
5
4
14
6
6a
3
15
16

SPRAYING ATOMIZED PARTICLES

This invention relates to the spraying of atomised particles, and more particularly to the production of a layer or coating of such particles upon a substrate.

For many years materials such as paints and metals have been sprayed on to surfaces for decorative or protective purposes. For example it has been proposed in U.K. Pat. No. 1,262,471 to provide an atomising nozzle in which a stream of liquid metal is atomised by the action of jets of gas impinging thereon, and then to direct the stream of particles so formed on to a substrate. However, it is usually required to coat the substrate uniformly with the atomised particles and hitherto this could not be achieved because the variation of particle distribution across the spray. In U.K. Pat. No. 1,262,471 it is proposed to modify the distribution of the stream of atomised particles by the use of jets of gas or suitably placed surfaces inclined at a relatively low angle to the direction of flight of the particles, but it is not suggested nor indeed has it been found possible to produce a uniform layer of metal particles upon a substrate by this method.

It has now been found that a more uniform distribution of particles on a substrate may be obtained by imparting an oscillation to the stream of atomised particles.

The present invention provides an apparatus for the spraying of atomised particles which comprises means for producing a stream of gas atomised particles, means for directing a secondary stream of gas against the stream of gas atomised particles and control means adapted for repeated cyclic operation for varying the secondary stream of gas in such a manner as, in operation, to deflect the stream of gas atomised particles and impart thereto an oscillation substantially in a single plane.

The invention also provides a process for spraying atomised particles which comprises producing a stream of gas atomised particles and directing a secondary stream of gas against the stream of gas atomised particles in such a manner as to deflect the stream of gas atomised particles and impart thereto an oscillation substantially in a single plane.

Furthermore the invention also provides an apparatus for the spraying of atomised particles which comprises means for producing a stream of gas atomised particles, means for directing a plurality of secondary streams of gas against the stream of gas atomised particles and flow control means adapted for repeated cyclic operation for varying the flow of the secondary streams of gas in such a manner as, in operation, to deflect the stream of gas atomised particles and impart thereto an oscillation substantially in a single plane.

In one embodiment of the invention, the apparatus comprises an atomising nozzle adapted to produce a stream of gas atomised particles, secondary nozzles situated adjacent to the atomising nozzle, and flow control means adapted for repeated cyclic operation for supplying the secondary nozzles sequentially with gas under pressure so that in operation the secondary gas streams issuing from the secondary nozzles deflect the stream of gas atomised particles and impart thereto an oscillation substantially in a single plane.

The stream of gas atomised particles may be directed on to a substrate which may be moved in a direction substantially at right angles to the plane of oscillation of the particle streams so that a uniform layer is built up on the surface of the substrate. It will be appreciated, however, that if desired, the present invention may be used for the coating of a substrate with a non-uniform layer of material. The invention may be applied to any material which may be gas atomised to form a stream of atomised particles and applies especially to such procedures as paint spraying and metal spraying. The gas atomised particles may be either liquid or solid or partially liquid and partially solid.

Although the invention is equally applicable to the spraying of surfaces with paint and other materials, the following description and examples will be confined to the application of the invention to the spraying of metals. It is to be understood, however, that the invention is not limited to metal spraying.

In a preferred embodiment of the invention, metal in a liquid or molten state is atomised directly by streams of gas in an atomising nozzle. Such a nozzle may, for example, comprise a metal feed outlet axially disposed with respect to an annular array of jets, arranged to direct stream of gas on to a stream of liquid or molten metal issuing from the outlet. The metal may also be atomised indirectly by feeding powder or wire into a source of heat such as an oxy-acetylene flame or an arc plasma to produce the molten state.

The gas used for atomising the liquid or molten metal may be air or any other suitable gas. Although air is suitable for some metals, there are other instances where the amount of oxidation caused by the use of air would be detrimental to the properties of the sprayed coating. In such cases gases that are unreactive or reducing to the metal concerned should be used. Examples are nitrogen for use with aluminium where oxide inclusions are to be avoided, and argon with iron-nickel-chromium alloys for the same reason.

A wide range of gas pressures may be applied to the atomising nozzle. For example the pressure at the atomising nozzle may vary from less than one pound per square inch up to several hundred pounds per square inch, preferably from 0.5 p.s.i. up to 1,000 p.s.i., such as for example about 100 p.s.i.

The gas used in deflecting the stream of gas atomised particles may be the same as or different from the atomising gas. The greater the pressure of the atomising gas the greater will be the pressure of the secondary gas stream required for deflection. Usually the maximum pressure of the secondary gas stream, for a given arrangement, will be of the same order of magnitude as the pressure of the gas of the atomising nozzle.

The size, number and relative geometry of the secondary nozzles may vary, and although one secondary nozzle may be used usually two secondary nozzles are preferred and these are preferably disposed one on each side of the atomising nozzle. In a particularly preferred embodiment of the invention an atomising nozzle and two secondary nozzles, disposed on each side thereof, lie in a plane which in operation is the plane of oscillation of the stream of particles. Usually the atomising nozzle will be arranged above the substrate and the oscillation will be in a substantially vertical plane.

The angle of the secondary nozzles, and thus the angle of the secondary gas streams to the stream of gas atomised particles is dependent upon the process conditions, and should be arranged such that the secondary gas streams have a component of motion which is at right angles and towards the undeflected direction of flow of the stream of atomised particles. For example the secondary nozzles may be set such that the secondary gas streams have a component of motion which is opposed to the undeflected direction of flow of the particle stream, and such an arrangement may be adopted when it is desired to decrease the kinetic energy of the particle stream. More usually, however, the secondary gas streams have a component of motion which is in the undeflected direction of flow of the particle stream, and the secondary nozzles are preferably set at an angle of from 30° to 60° to the undeflected direction of flow of the stream of atomised particles and in the general direction thereof, e.g. at an angle of 45°.

Generally speaking, the denser metals require a greater amount of deflecting energy than the less dense metals. By arranging the angle of the secondary nozzles and the timing of the gas pressure pulses thereto it is possible to obtain a substantially uniform distribution of metal particles on the surface of a substrate placed in the path of the particle stream. By the same token it is also possible to obtain a distribution of metal particles on the surface of a substrate which is non-uniform and which may be predetermined by appropriate choice of angle of secondary nozzles and timing of gas pressure pulses thereto.

It has been found convenient to use rows of holes for the secondary nozzles because they maintain their dimensions over long periods of time. However it is also possible to use slots for the secondary gas streams, and this has the advantage that the nozzle aperture can easily be made adjustable.

The apparatus is provided with control means adapted for repeated cyclic operation for varying the secondary stream of gas. Preferably the control means is a flow control means and includes means for generating cycles of variation in the supply of the secondary stream of gas. In a preferred embodiment, the secondary nozzles are supplied sequentially with gas under pressure from the same source, although the invention does not preclude different gases or different pressures being used at each secondary nozzle. It is desirable to arrange the supply of gas to the secondary gas nozzles so as to impart a rapid oscillation to the stream of atomised particles. Also it is desirable that the build up and relaxation of gas pressure at the secondary nozzles should take place in a continuously increasing and decreasing manner (i.e. not just a simple on/off switching of the secondary gas flow). In this latter respect the dimensions of the apparatus e.g. the length and bore of piping between the gas supply and the secondary nozzles should be chosen having regard to the compressibility of the gas.

In a particularly preferred embodiment according to the invention the secondary nozzles are supplied with gas under pressure from a rotary valve, which may for instance be a valve actuated by a rotating shaft or rotating disc. The speed of the rotary valve may be varied as required; for example when the atomising nozzle is arranged above a moving substrate the speed of rotation of the valve, and consequently the frequency of oscillation of the stream of particles, may be varied to suit the speed of advance of the substrate. With each half-oscillation of the particle stream a layer of metal particles will be laid on the substrate which may be overlaid with further layers in subsequent oscillations. Usually the final coating is at least 2 particle layers in thickness and may of course be considerably greater.

Suitable speeds of operation for rotary valves lie between 50 and 5,000 rpm though for most conditions of usage speeds of operation lying between 100 and 1,000 rpm have been found to be most satisfactory. Correspondingly suitable speeds of advance for the substrate are from 1 to 100 metres per minute depending on the required thickness of the deposited layer. Although a rotary valve is preferred, it is possible to use other means of supplying and switching the gas supply to the secondary nozzles using established pneumatic procedures.

The secondary gas stream or streams impart an oscillation to the stream of gas atomised particles which is substantially in a single plane.

In a preferred embodiment of the present invention the stream of particles oscillates about a mean position which may correspond to the undeflected primary direction of flow of the stream of particles. The invention can enable a wide layer of sprayed deposit to be laid down from a stationary atomising nozzle, or alternatively if the nozzle is to be moved, for instance in the case of hand spraying using a metal wire feed, a wide deposit can be obtained with the minimum of hand movement.

Although the invention can be applied to hand held spraying devices, it is particularly suitable for use in an apparatus which comprises a stationary atomising nozzle and means for moving a substrate relative to the nozzle in such a manner as to deposit a layer of particles upon the substrate. The deposited layer of metal particles may remain on the substrate, for example as a corrosion protecting coating, or may be stripped off and rolled, for example in the production of metal sheets, plates or coils.

The invention is particularly applicable to the process of spray rolling of metals as described in British Pat. No. 1,262,471. When it is required to cover a wide strip with a sprayed deposit in a continuous or semi-continuous operation, two or more atomising nozzles may be used side by side with a suitable overlap of the particle stream, or alternatively, may be used in sequence with one another. The nozzles may be arranged so that the streams of atomised particles remain substantially parallel and in phase with one another for example, by supplying the secondary gas streams from rotary valves operated by the same shaft.

The invention is illustrated by the following Example:

EXAMPLE

FIG. 1 shows diagrammatically in side elevation an embodiment of an apparatus according to the invention.

The apparatus comprises a holding vessel 1 for molten metal, having a passage 2 in its base leading to an atomising chamber 3. The passage 2 terminates in a primary atomising nozzle 4 having atomising jets 5 connected to a source of nitrogen under pressure. The jets 5 comprise a seven-sixteenth inch diameter annular array of 12 holes each 0.060 inch in diameter and making an apex angle of 20°. Secondary deflecting nozzles 6 and 6a are positioned adjacent to the atomising nozzle, and are connected to a source of nitrogen under pressure via a rotary valve 7. The secondary deflecting nozzles each consist of a line of 10 holes, each of 0.031 inch diameter, the row having a total length of five-eighths inch. The valve comprises a shaft 8 having a flat 9 on one surface, the shaft being rotatable within a cylinder 10 having a nitrogen inlet port 11 and outlet ports 12 and 13. The outlet ports are connected by flexible pipes 14 to the secondary nozzles. Situated beneath the atomising nozzle is a movable substrate 15. The atomising chamber is provided with an exhaust port 16.

In operation molten aluminium from the holding vessel 1 passes along the passage 2 (diameter 3 mm) and is atomised by nitrogen issuing from the jets 5. Nitrogen is supplied at 80 lbs. per sq. in. pressure to the jets. The shaft 8 is rotated at a speed of 480 rpm and nitrogen at 120 lbs. per sq. in. pressure is fed into an annular chamber 11a at the rear of the rotary valve 7 through the inlet 11. As the shaft turns, the flat portion allows nitrogen to flow from the annular chamber 11a first through outlet port 12 and from thence to the left hand secondary nozzle 6. Further movement of the shaft cuts off the nitrogen supply and hence the deflecting gas stream. Still further movement of the shaft permits nitrogen to flow through the outlet 13 and thence to the right hand deflecting nozzle 6*a*. The total effect is that the stream of atomised particles is caused to oscillate from side to side in a vertical plane.

Finally the oscillating spray impinges upon the surface of a substrate placed beneath the spray at a direction of 12 inches from the atomising nozzle. The width of substrate surface covered by the spray is found to be 16 inches. The substrate surface is moved perpendicular to the plane of the deflecting nozzles at a rate of 8 inches per sec. so that at each traverse of the oscillating spray the surface moves forward approximately 1 inch. In this way a uniform deposit of aluminium may be formed on the surface by the action of the metal spray scanning the surface.

The angle of the secondary nozzles and the timing of the gas pressure pulses may be arranged in such a way that a uniform distribution on the substrate surface is obtained. The size of the flat on the shaft and the positions of the outlet ports should preferably be arranged such that there is a suitable interval between the application of pressure to the left hand deflection nozzle and the right hand deflection nozzle. In the apparatus illustrated the flat subtends as angle of 97° at the shaft centre and the outlet ports are diametrically opposed.

The use of a rotary valve has the advantage that there is a gradual build up and falling off of pressure at each nozzle in turn because the gas outlet ports are covered and uncovered gradually as the flat of the shaft sweeps past. At each secondary nozzle the gradually increasing gas pressure exerts a gradually increasing deflection on the stream of atomised particles until full pressure in the secondary nozzle is attained. Similarly the pressure decays gradually and deflection decreases as the trailing edge of the flat on the shaft passes the relevant outlet port. The outlet ports in the apparatus are circular but other shaped ports for example triangular shapes may be used to obtain uniform or specially contoured sprayed deposits in certain cases. Again, in the apparatus only one secondary nozzle is used on each side of the stream of atomised particles and this will normally be found to give satisfactory results. However it is possible to use two or more secondary nozzles at each side for example pointing at different angles to the stream of atomised metal particles but in the same plane, each independently supplied with gas.

The invention enables good control to be exercised over the distribution of the deposited layer of metal during operation. For example, the gas pressures supplied to the secondary nozzles in relation to that supplied to the main atomising nozzle can be controlled from outside the atomising chamber. The speed of the rotary valve may also be varied as required. Similarly, it is possible to arrange for the angle or position of the secondary nozzles to be altered at will during operation. A further advantage is that by virtue of its scanning procedure the invention enables the liquid metal particles to be quenched on the substrate surface extremely rapidly because the first deposited layer of particles is cooled to near substrate temperature before the return of the scanning stream whereupon a further layer is deposited over the first.

In the Example, the aluminium layer on the substrate may be stripped off and may be subsequently rolled to form an aluminium sheet, or left as a protective coating, either as deposited or in the rolled condition, for example in the production of aluminium coated mild steel.

I claim:

1. Apparatus for the spraying of atomised particles, which comprises means for producing a coherent stream of gas atomised particles, means for directing a secondary stream of gas against the stream of gas atomised particles and control means adapted for repeated cyclic operation for varying the flow of the secondary stream of gas in such a manner as, in operation, to deflect the stream of gas atomised particles and impart thereto an oscillation substantially in a single plane.

2. Apparatus according to claim 1, which comprises means for producing a coherent stream of gas atomised particles, means for directing a plurality of secondary streams of gas against the stream of gas atomised particles and flow control means adapted for repeated cyclic operation for varying the flow of the secondary stream of gas in such a manner as, in operation, to deflect the stream of gas atomised particles and impart thereto an oscillation substantially in a single plane.

3. Apparatus according to claim 1, comprising an atomising nozzle adapted to produce a coherent stream of gas atomised particles, secondary nozzles situated adjacent to the atomising nozzle, and flow control means adapted for repeated cyclic operation for supplying the secondary nozzle sequentially with gas under pressure so that, in operation, the secondary gas streams issuing from the secondary nozzles deflect the flow of the stream of gas atomised particles and impart thereto an oscillation substantially in a single plane.

4. Apparatus according to claim 1, that comprises an atomising nozzle comprising a metal feed outlet axially disposed with respect to an annular array of gas jets, the jets being arranged in such a manner as, in operation, to direct streams of gas on to a stream of liquid or molten metal issuing from the outlet.

5. Apparatus according to claim 3, which comprises two secondary nozzles, disposed on each side of the atomising nozzle.

6. Apparatus according to claim 5, in which the atomising nozzle and secondary nozzle lie in a plane, which in operation is the plane of oscillation of the stream of atomised particles.

7. Apparatus according to claim 1, which comprises means for directing the secondary stream of gas so arranged that the secondary stream of gas has a component of motion in the undeflected direction of flow of the coherent stream of gas atomised particles.

8. Apparatus according to claim 7, in which the means for directing the secondary stream of gas are at an angle of from 30° to 60° to the undeflected direction of flow of the stream of gas atomised particles.

9. Apparatus according to claim 1, in which the control means comprises flow-control means including means for generating cycles of variation in the supply of the secondary stream of gas.

10. Apparatus according to claim 9 which comprises means for sequentially supplying the secondary nozzles with gas under pressure from the same source.

11. Apparatus according to claim 9, in which the control means comprises a rotary valve.

12. Apparatus according to claim 11 comprising an axially rotable shaft having a longitudinal flat, disposed within a cylinder having a gas inlet and a plurality of gas outlet parts the arrangement being such that in operation rotation of the shaft delivers gas from the inlet part sequentially to the outlet parts via the chamber formed by the flat portion of the shaft and the cylinder.

13. Apparatus according to claim 1, which comprises means for moving a substrate relative to the gas atomising means in such a manner that in operation, a layer of atomised particles is deposited upon the substrate.

14. Apparatus according to claim 9 which comprises means for moving the substrate in a direction which, in operation, is substantially at right angles to the plane of oscillation of the particle stream.

* * * * *